US012599263B2

(12) United States Patent
Hsu et al.

(10) Patent No.: US 12,599,263 B2
(45) Date of Patent: Apr. 14, 2026

(54) UNIVERSAL TREETOP MOUNT

(71) Applicants: Yung-Chen Hsu, New Taipei City (TW); Ling-Yung Lin, Taipei (TW)

(72) Inventors: Yung-Chen Hsu, New Taipei City (TW); Ling-Yung Lin, Taipei (TW)

( * ) Notice: Subject to any disclaimer, the term of this patent is extended or adjusted under 35 U.S.C. 154(b) by 115 days.

(21) Appl. No.: 18/754,485

(22) Filed: Jun. 26, 2024

(65) Prior Publication Data

US 2026/0000231 A1 Jan. 1, 2026

(51) Int. Cl.
*A47G 33/08* (2006.01)

(52) U.S. Cl.
CPC ..... *A47G 33/08* (2013.01); *A47G 2033/0827* (2013.01); *A47G 2033/089* (2013.01)

(58) Field of Classification Search
CPC ..... A47G 33/08; A47G 33/10; A47G 2033/0827; A47G 2033/089
See application file for complete search history.

(56) References Cited

U.S. PATENT DOCUMENTS 9,204,748 B2 * 12/2015 Loomis ..... F21V 23/06
10,547,138 B1 * 1/2020 Huang ..... H01R 33/72
10,799,054 B2 * 10/2020 Long ..... H05B 47/155
12,433,439 B2 * 10/2025 Xu ..... A47G 33/06
2022/0104648 A1 * 4/2022 Zhao ..... A47G 33/10
2024/0347977 A1 * 10/2024 Yu ..... H01R 43/26
2025/0176749 A1 * 6/2025 Lin ..... A47F 5/025
2025/0325134 A1 * 10/2025 Pas ..... A47G 33/06

* cited by examiner

*Primary Examiner* — Matthew J. Peerce
(74) *Attorney, Agent, or Firm* — RABIN & BERDO, P.C.

(57) ABSTRACT

A universal treetop mount for fixedly coupling a treetop decorative light to the top end of the main body of a tree-shaped decoration includes a mount body whose bottom side has a connecting portion for coupling with the main body of the tree-shaped decoration, and whose top side forms an upper mount surface for coupling with the treetop decorative light. A hollow positioning tube extends upward from a central position on the upper mount surface and is peripherally provided with a position-limiting groove. Blocking units are provided around the position-limiting groove to retain an object received in the position-limiting groove. When the connecting portion, which includes a connecting tube and a clamping unit, is coupled with the main body of the tree-shaped decoration, the connecting tube is coupled with a connected portion at the top end of a main trunk, and the clamping unit is clamped to the connected portion.

19 Claims, 8 Drawing Sheets

UNIVERSAL TREETOP MOUNT

BACKGROUND OF THE INVENTION

1. Technical Field

The present invention relates to a fixing structure for a treetop decorative light. More particularly, the invention relates to a universal treetop mount that is suitable for being mounted and coupled with various kinds of treetop decorative lights and can greatly enhance the ease of assembly of a tree-shaped decoration.

2. Description of Related Art

Nowadays, tree-shaped decorations made by placing or hanging flashing decorative lights on a tree-like body are frequently used on holidays to add to the festive atmosphere. One notable example is decorated Christmas trees, which are commonly seen at Christmas time.

When it comes to treetop decorative lights on the market, three fixing means are typically used so that a consumer can mount such a decorative light on a treetop. The first means generally entail a rod-like object (e.g., a straight tube/bar) that is provided with Velcro (a hook-and-loop fastener/touch fastener) and configured to support a decorative light at the top end and be tied to a treetop branch at the other end by the user using the Velcro. The second means employ a connecting rod equipped with a clamp. A decorative light can be coupled to the connecting rod at a position above the clamp, before the clamp is operated by the user and clamped to a treetop branch. The third means involve a conical spiral support that is formed of a spiral metal or plastic tube/wire and configured to support a decorative light from below and be mounted around a treetop.

During use, however, the three means for fixing a treetop decorative light (or the structures used in the three means) tend to have problem maintaining the center of gravity of the treetop decorative light, and hence difficulty in mounting the treetop decorative light securely, even after the fixing structures are tied to, clamped to, or mounted around a treetop, the problem and difficult being attributable to the fact that branches and leaves are distributed at different densities around the treetop. While a user may use additional accessories for reinforcement, the use of accessories not only increases the user's workload during the mounting process, but also may put too much weight on the treetop and thus tip the balance of the tree-shaped decoration as a whole if too many accessories are used.

Besides, a conventional treetop decorative light generally requires an additional power strip whose cable extends, for example, from an extension power source on the ground to a treetop. The power connection operation involved is nevertheless extremely inconvenient, which has long caused trouble to treetop decorative light users.

In view of the above, and in order to solve the aforesaid problems of the conventional treetop decorative lights during use, the present invention discloses a universal treetop mount structure that is both easy to mount and stable so as to provide an improvement over the prior art.

BRIEF SUMMARY OF THE INVENTION

The primary objective of the present invention is to provide a universal treetop mount that allows various kinds of treetop decorative lights to be fixedly and securely coupled to the top end of the main body of a tree-shaped decoration.

Furthermore, the universal treetop mount of the present invention provides ease of assembly. Electrical connection to an internal circuit is established during the assembly process, and electrical energy can be supplied to a treetop decorative light directly through a power socket on a lateral side of the treetop mount. The simplified electrical connection arrangement reduces the inconvenience and difficulty of power connection in the prior art.

The universal treetop mount of the present invention allows a treetop decorative light to be fixedly coupled to the top end of the main body of a tree-shaped decoration, and the technical means and structural features adopted by the invention include a mount body whose bottom side is provided with a connecting portion for coupling with the main body of the tree-shaped decoration, and whose top side forms an upper mount surface on which the treetop decorative light can be mounted and to which the treetop decorative light can be coupled.

A hollow positioning tube is formed at, and extends upward from, a central position on the upper mount surface. The periphery of the hollow positioning tube is circumferentially provided with a sunken position-limiting groove. The periphery of the position-limiting groove is provided with a plurality of blocking units that are arranged at intervals and configured to prevent an object received in the position-limiting groove from moving out of the position-limiting groove.

The connecting portion includes a connecting tube and at least one clamping unit. The connecting tube is provided at the center of the bottom side of the mount body, extends downward, and is so configured that when coupled with the main body of the tree-shaped decoration, the connecting tube is inserted in the interior of, and thus coupled with, a connected portion at the top end of a main trunk of the main body of the tree-shaped decoration. The clamping unit is provided around the connecting tube and is so configured that when coupled with the main body of the tree-shaped decoration, the clamping unit is clamped to the side of the connected portion that faces away from the connecting tube.

The foregoing structures are such that the connecting portion on the bottom side of the treetop mount can be easily mounted on and coupled to the top end of the main body of the tree-shaped decoration, and that various types of treetop decorative lights can be securely mounted on and coupled to the upper mount surface of the top side of the treetop mount. The present invention, therefore, provides great ease of use and operation.

In addition, the foregoing structures are so designed that the clamping unit forms a clamping wall extending downward from the bottom side of the mount body, and that the inner side of the clamping wall is protrudingly provided with a protruding tooth for pressing against the connected portion, thereby allowing the treetop mount to be even more securely fixed to the top end of the main body of the tree-shaped decoration.

Preferably, there are a plurality of such clamping units, and the clamping units are arranged at intervals around, and along the circumference of, the connecting tube.

Furthermore, the foregoing structures of the present invention are so designed that the main trunk is provided therein with an internal circuit for conducting electrical energy, that the interior of the connected portion is provided with an in-trunk electrical connection terminal electrically connected to the internal circuit, and that the connecting portion is provided with an in-mount electrical connection terminal inside the connecting tube. When the connecting portion is coupled with the connected portion, the in-mount electrical connection terminal of the connecting portion and the in-trunk electrical connection terminal in the connected portion are in contact, and hence in electrical connection, with each other.

Moreover, the mount body is provided therein with a circuit board for voltage conversion and has a lateral side formed with at least one power socket electrically connected to the circuit board. The circuit board is electrically connected to the in-mount electrical connection terminal and is configured to convert an input voltage into an output voltage suitable for the treetop decorative light and to output the output voltage to the power socket. Thus, once electrical connection to the internal circuit is established, the circuit board in the treetop mount of the present invention can provide voltage conversion and allows electrical energy that has gone through the voltage conversion to be directly supplied to the treetop decorative light. This eliminates the trouble of having to use a power strip for power connection as is typically the case with the prior art.

Preferably, the power socket is a universal serial bus (USB) socket or a direct-current (DC) socket.

The foregoing structures are so designed that the main body of the tree-shaped decoration further includes a power connector for connecting with a power source, and that the power connector is electrically connected to the internal circuit.

Moreover, the main body of the tree-shaped decoration at least includes a lower trunk portion and an upper trunk portion. The power connector is provided at the lower trunk portion, and the connected portion is provided at the top end of the upper trunk portion. The top end of the lower trunk portion and the bottom end of the upper trunk portion are provided with an upper connecting portion and a lower connecting portion respectively, wherein the upper and lower connecting portions are configured to couple with each other. The lower trunk portion is provided with an upper electrical connection terminal inside the upper connecting portion, and the portion of the internal circuit that is in the lower trunk portion is electrically connected to the power connector and the upper electrical connection terminal. The upper trunk portion is provided with a lower electrical connection terminal inside the lower connecting portion, and the portion of the internal circuit that is in the upper trunk portion is electrically connected to the lower electrical connection terminal and the in-trunk electrical connection terminal. When the lower connecting portion is coupled with the upper connecting portion, the lower electrical connection terminal in the lower connecting portion and the upper electrical connection terminal in the upper connecting portion are in contact, and hence in electrical connection, with each other.

The main body of the tree-shaped decoration may further include at least one middle trunk portion whose two ends are each provided with one or the other of an upper connecting portion similar to that of the lower trunk portion and a lower connecting portion similar to that of the upper trunk portion, with the upper and lower electrical connection terminals in the upper and lower connecting portions of the middle trunk portion electrically connected to the internal circuit in order for the middle trunk portion to form an intermediate portion connectable between the upper and lower trunk portions.

In one feasible embodiment, the treetop decorative light includes a decorative light element and a supporting rod connected to and located under the decorative light element. When the treetop decorative light is mounted on and coupled with the upper mount surface, the supporting rod is inserted in, and thus coupled with, the hollow positioning tube such that the treetop decorative light is securely fixed at the top end of the main body of the tree-shaped decoration.

In one feasible embodiment, the treetop decorative light includes a decorative light element, a clamping element under the decorative light element, and a connecting rod connected between the decorative light element and the clamping element. When the treetop decorative light is mounted on and coupled with the upper mount surface, the clamping element is fixedly clamped to the outer side of the hollow positioning tube such that the treetop decorative light is securely fixed at the top end of the main body of the tree-shaped decoration.

In one feasible embodiment, the treetop decorative light includes a decorative light element and a conical spiral support connected to and located under the decorative light element. When the treetop decorative light is mounted on and coupled with the upper mount surface, a bottom portion of the conical spiral support is received in the position-limiting groove and is limited in position by the blocking units such that the treetop decorative light is securely fixed at the top end of the main body of the tree-shaped decoration.

Preferably, the blocking units are barbs provided on a protruding edge formed around, and protruding with respect to, the position-limiting groove, extend inward of the position-limiting groove, and are elastic.

Preferably, the blocking units are plate-shaped elements provided on a protruding edge formed around, and protruding with respect to, the position-limiting groove, can be rotated, and are elastic.

Preferably, the blocking units are screws extending through a protruding edge formed around, and protruding with respect to, the position-limiting groove, and the distance for which each screw extends into the position-limiting groove can be adjusted.

BRIEF DESCRIPTION OF THE SEVERAL VIEWS OF THE DRAWINGS

The foregoing objective, intended effects, and technical features of the present invention can be better understood by referring to the following preferred embodiments of the invention in conjunction with the accompanying drawings, in which.

DETAILED DESCRIPTION OF THE INVENTION

Figure 1A:
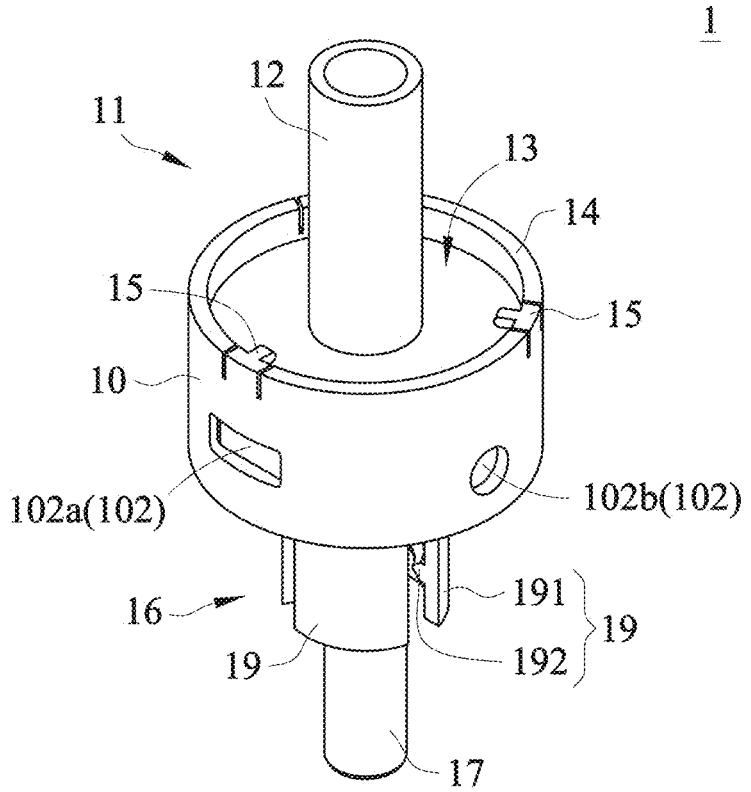
FIG. 1A is a perspective view of the treetop mount according to a preferred embodiment of the invention.
Figure 1B:
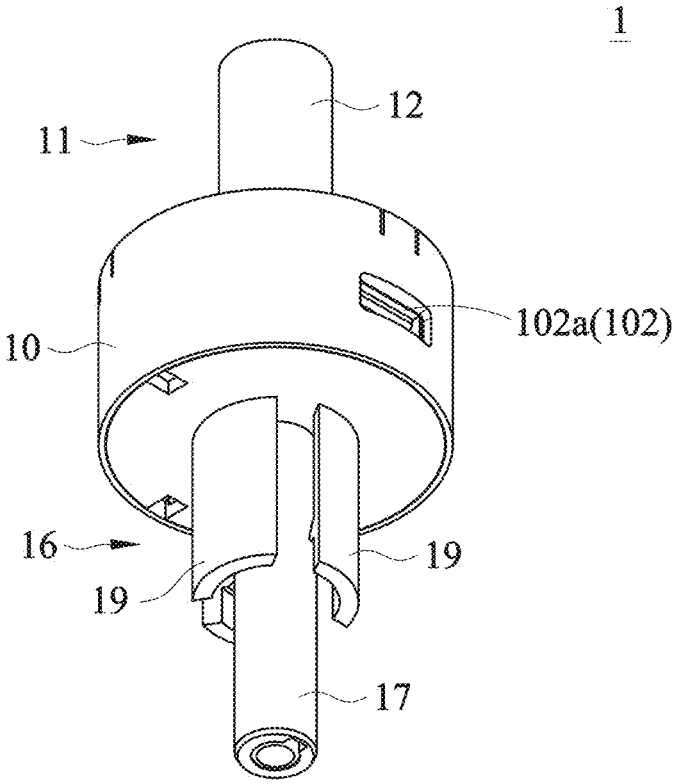
FIG. 1B is a perspective view of the treetop mount according to the preferred embodiment in FIG. 1A but from a different viewing angle from that of FIG. 1A.
Figure 7:
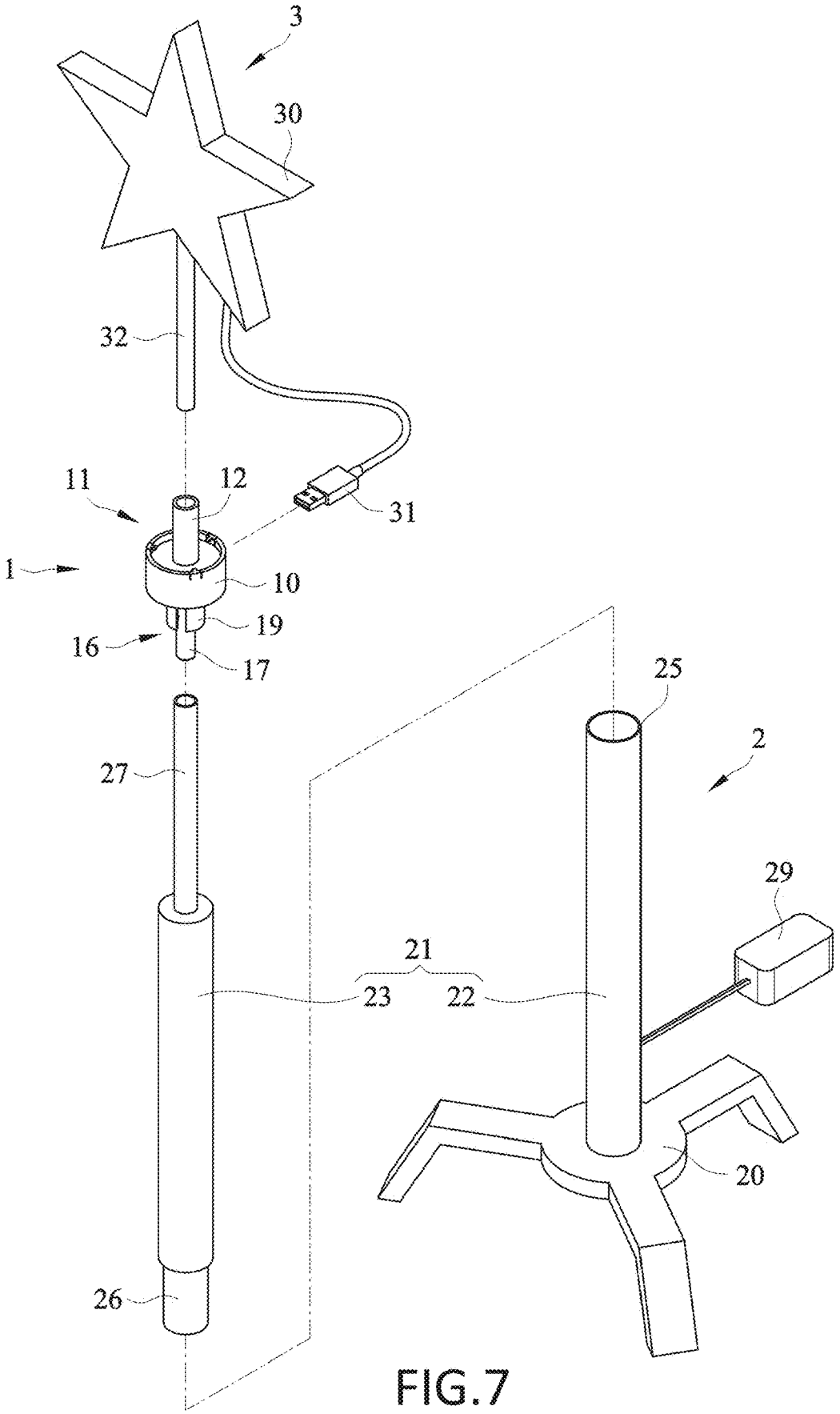
FIG. 7 is an exploded view of an assembly of the treetop mount according to the preferred embodiment in FIG. 1A, a treetop decorative light, and a tree-shaped decoration.

Referring to FIG. 1A, FIG. 1B, and FIG. 7, the universal treetop mount 1 according to this embodiment is configured to fixedly couple a treetop decorative light 3 to the top end of the main body 2 of a tree-shaped decoration. The treetop mount 1 is composed essentially of a mount body 10. The mount body 10 is in the shape of a cylinder or a circular block, has a bottom side provided with a connecting portion 16 for coupling with the main body 2 of the tree-shaped decoration, and has a top side provided with an upper mount surface 11 to which the treetop decorative light 3 can be mounted and coupled.

The structural design of the upper mount surface 11 of the treetop mount 1 is such that various types of treetop decorative lights 3 can be securely mounted on and coupled to the upper mount surface 11. The upper mount surface 11 essentially includes a hollow positioning tube 12, a sunken position-limiting groove 13, and a plurality of blocking units 15. The hollow positioning tube 12 is provided at a central position on the upper mount surface 11 and extends upward along the axial direction of the mount body 10. The position-limiting groove 13 is provided around the periphery, and along the circumference, of the hollow positioning tube 12 and forms a protruding edge 14 that extends along the outer periphery of the position-limiting groove 13 and is protruding with respect to the position-limiting groove 13. The blocking units 15 are provided on, and along the circumference of, the protruding edge 14, are arranged at intervals, and are configured to prevent an object received in the position-limiting groove 13 from moving out of the position-limiting groove 13.

The connecting portion 16 provided on the bottom side of the treetop mount 1 includes a connecting tube 17 and at least one clamping unit 19. The connecting tube 17 is provided at the center of the bottom side of the mount body 10, extends downward, and is so configured that when coupled with the main body 2 of the tree-shaped decoration, the connecting tube 17 is inserted in the interior of, and thus coupled with, a connected portion 27 at the top end of a main trunk 21 of the main body 2 of the tree-shaped decoration. The clamping unit 19 is provided around the connecting tube 17 and is so configured that when coupled with the main body 2 of the tree-shaped decoration, the clamping unit 19 is clamped to the side of the connected portion 27 that faces away from the connecting tube 17 such that, with the clamping unit 19 mounted around the outer side of the connected portion 27 to produce a securely fixing effect, the mount body 10 is firmly fixed at the top end of the main trunk 21.

In this embodiment, there are a plurality of clamping units 19, and the clamping units 19 are provided at intervals around, and along the circumference of, the connecting tube 17 and have the elasticity to expand slightly so as to form clamping members that can be clamped to the connected portion 27. Each clamping unit 19 includes a clamping wall 191 and a protruding tooth 192, wherein the clamping wall 191 is a wall extending downward from the bottom side of the mount body 10, and wherein the protruding tooth 192 is provided on, and protrudes from, the inner side of the clamping wall 191 to press against the connected portion 27. In one feasible embodiment, the at least one clamping unit 19 may be an annular wall provided around, and along the circumference of, the connecting tube 17.

Figure 8:
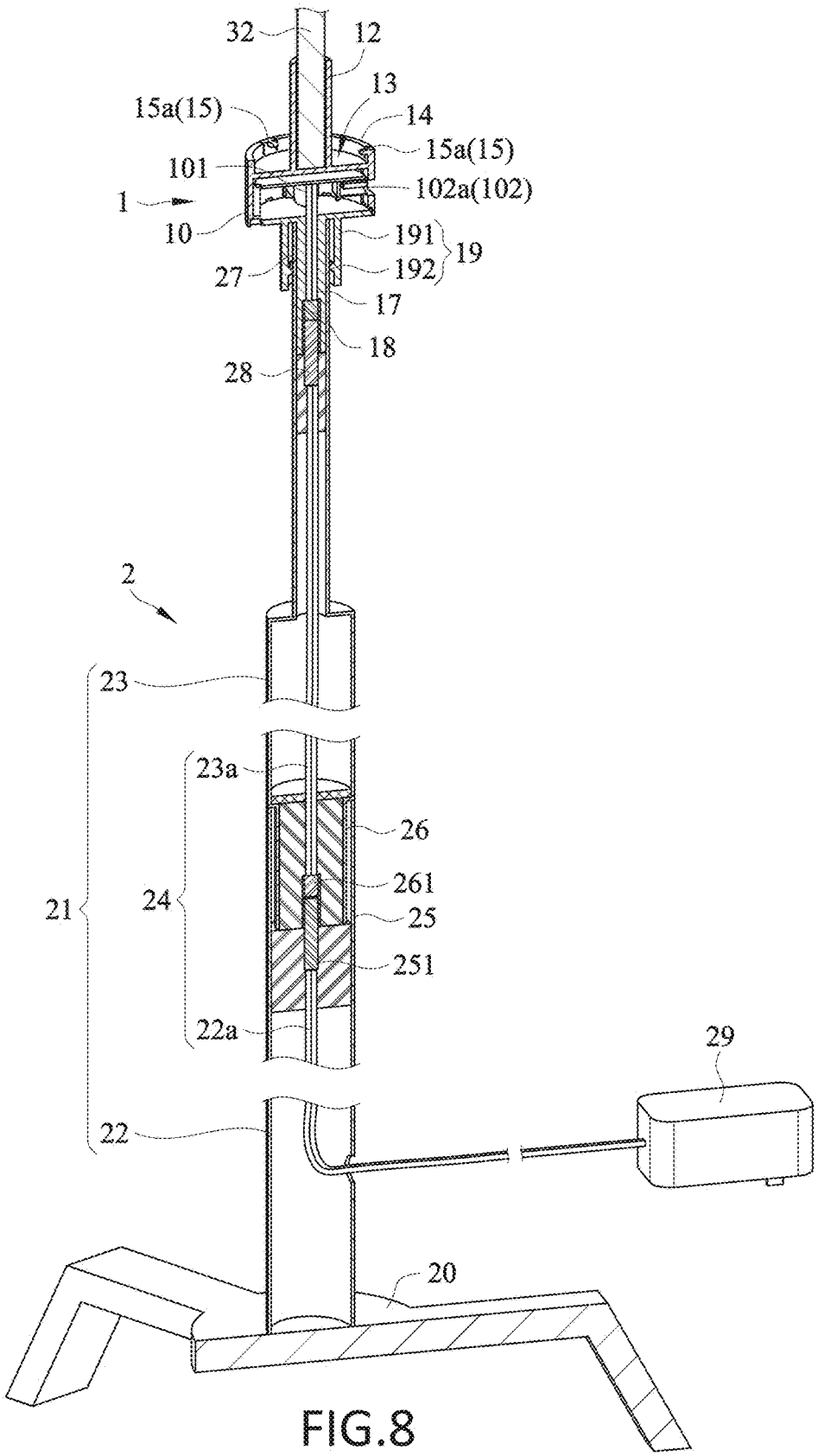
FIG. 8 is an assembled sectional view of the assembly in FIG. 7.

Referring to FIG. 8, the main trunk 21 in this embodiment is provided therein with an internal circuit 24 for conducting electrical energy, the interior of the connected portion 27 is provided with an in-trunk electrical connection terminal 28 electrically connected to the internal circuit 24, and the connecting portion 16 is provided with an in-mount electrical connection terminal 18 inside the connecting tube 17. Once the connecting portion 16 is coupled to the connected portion 27, the in-mount electrical connection terminal 18 of the connecting portion 16 and the in-trunk electrical connection terminal 28 in the connected portion 27 are in contact, and hence in electrical connection, with each other. Furthermore, the treetop mount 1 is provided with a circuit board 101 that is inside the mount body 10 and electrically connected to the in-mount electrical connection terminal 18, and a lateral side of the mount body 10 is formed with at least one power socket 102 electrically connected to the circuit board 101. The circuit board 101 has a built-in circuit for voltage conversion and is configured to convert an input voltage into an output voltage suitable for the treetop decorative light 3 and to output the output voltage to the power socket 102. In this embodiment, the circuit board 101 has a built-in buck converter circuit for reducing a 12-30 Vdc voltage, which is generally used by light strings to be put around the trunk portion of a tree-shaped decoration, to a 5 Vdc voltage, which is suitable for use by common treetop decorative lights 3, so that the treetop mount 1 of the present invention can be widely used with common decorative lights and light string products on the market. This embodiment is so designed that the internal circuit 24 can conduct electrical energy to the treetop mount 1, which in turn supplies electricity directly to the treetop decorative light 3. This effectively eliminates the trouble of having to use an additional cable for power connection as is typically the case with the prior art. In one feasible embodiment, the lateral side of the mount body 10 may be provided with a plurality of power sockets 102, and the power sockets 102 may be universal serial bus (USB) sockets 102*a* or direct-current (DC) sockets 102*b*.

Figure 2:
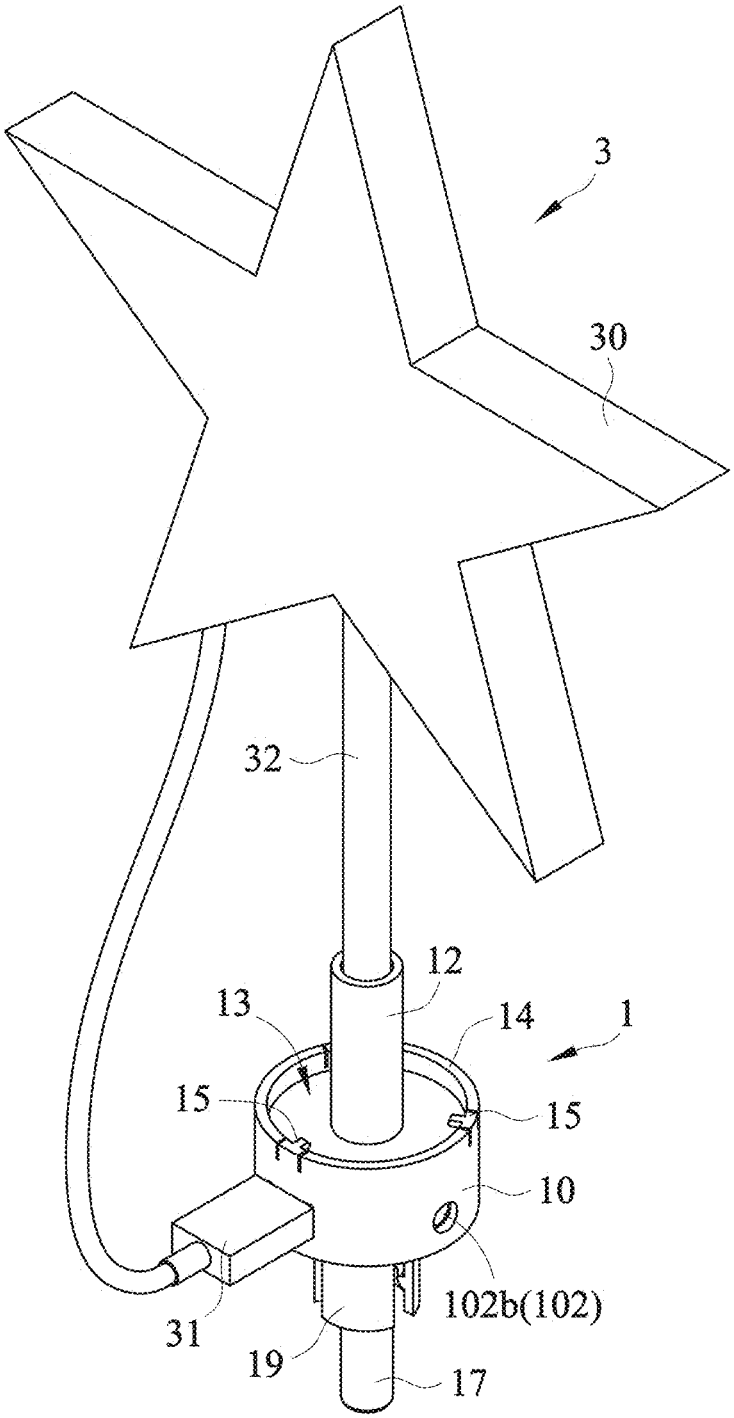
FIG. 2 shows how a treetop decorative light with a straight rod is mounted on and coupled with the treetop mount according to the preferred embodiment in FIG. 1A.
Figure 3:
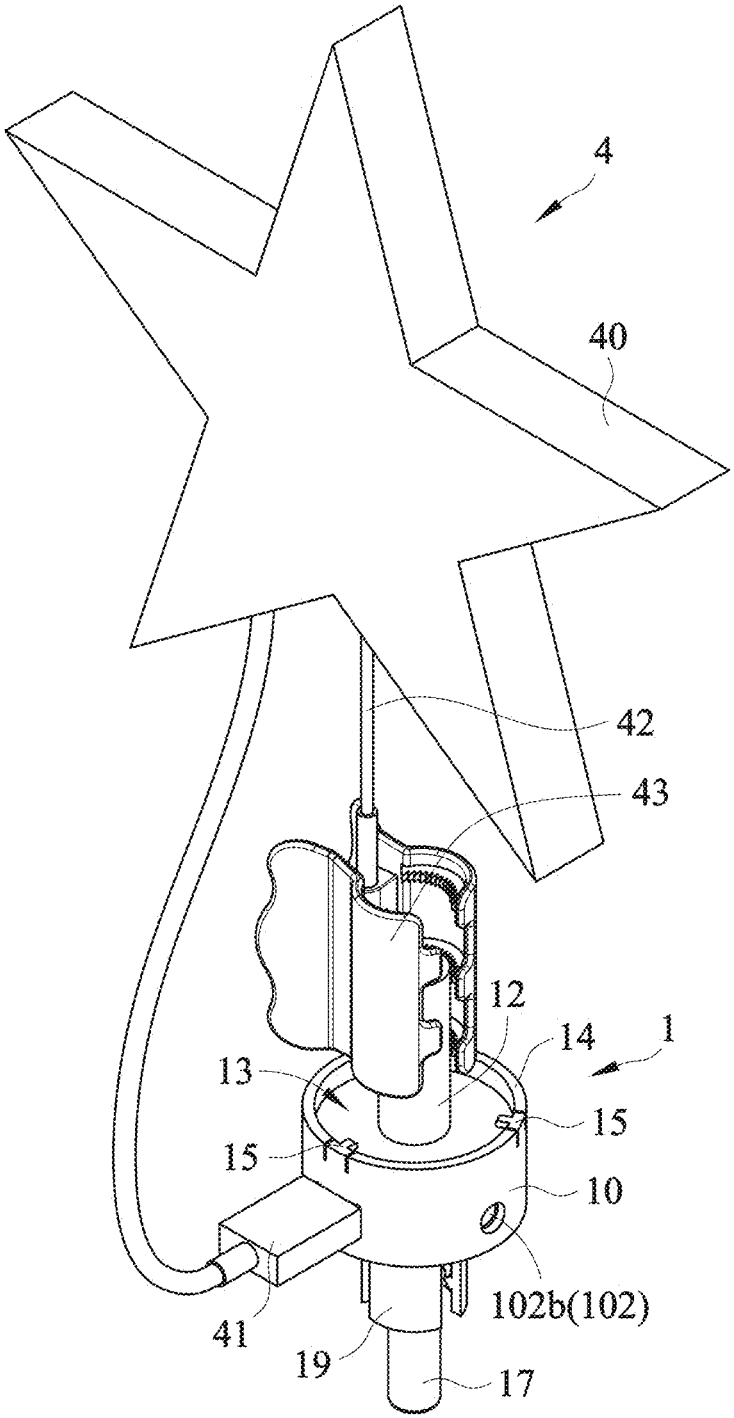
FIG. 3 shows how a treetop decorative light with a clamp is mounted on and coupled with the treetop mount according to the preferred embodiment in FIG. 1A.
Figure 4:
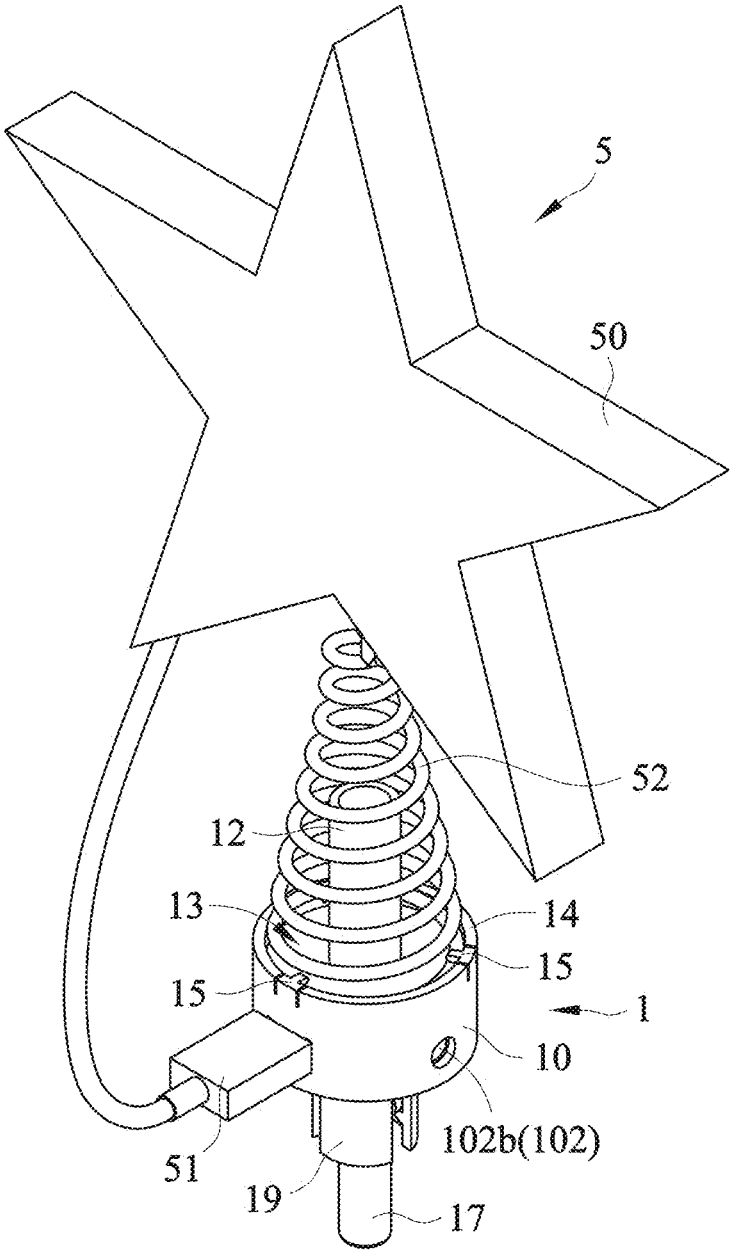
FIG. 4 shows how a spiral treetop decorative light is mounted on and coupled with the treetop mount according to the preferred embodiment in FIG. 1A.

In practice, referring to FIG. 2 to FIG. 4, several different treetop decorative light configurations are known, and the corresponding products can be generally divided according to their fixing structure into a treetop decorative light 3 with a straight rod, as shown in FIG. 2; a treetop decorative light 4 with a clamp, as shown in FIG. 3; and a spiral treetop decorative light 5, as shown in FIG. 4. The universal treetop mount 1 of the present invention is suitable for being securely mounted with and coupled to any of the treetop decorative lights 3, 4, and 5.

Referring to FIG. 2, the treetop decorative light 3 essentially includes a decorative light element 30, a power connector 31, and a supporting rod 32 connected to and located under the decorative light element 30. Once the treetop decorative light 3 is mounted on and coupled to the upper mount surface 11, the supporting rod 32 is inserted in, and thus coupled with, the hollow positioning tube 12 such that the decorative light element 30 is firmly supported above the treetop mount 1. The treetop decorative light 3, therefore, is securely fixed at the top end of the main body 2 of the tree-shaped decoration. Moreover, the power connector 31 of the treetop decorative light 3 can be directly inserted into, and thus connected to, the power socket 102 on the lateral side of the mount body 10 to achieve ease of assembly.

Referring to FIG. 3, the treetop decorative light 4 essentially includes a decorative light element 40, a power connector 41, a clamping element 43 under the decorative light element 40, and a connecting rod 42 connected between the decorative light element 40 and the clamping element 43. Once the treetop decorative light 40 is mounted on and coupled to the upper mount surface 11, the clamping element 43 is securely fixed on the outer side of the hollow positioning tube 12 in a clamping manner such that the decorative light element 40 is firmly supported above the treetop mount 1. The treetop decorative light 4, therefore, is securely fixed at the top end of the main body 2 of the tree-shaped decoration. Similarly, the power connector 41 of the treetop decorative light 4 can be directly inserted into, and thus connected to, the power socket 102 on the lateral side of the mount body 10 to achieve each of assembly.

Referring to FIG. 4, the treetop decorative light 5 essentially includes a decorative light element 50, a power connector 51, and a conical spiral support 52 connected to and located under the decorative light element 50. The conical spiral support 52 is a conical structure formed by winding a metal or plastic tube/wire spirally. Once the treetop decorative light 5 is mounted on and coupled to the upper mount surface 11, the tube/wire in a bottom portion of the conical spiral support 52 is received in the position-limiting groove 13 and is limited in position by the blocking units 15 and hence prevented from moving out of the position-limiting groove 13. The treetop decorative light 5, therefore, is securely fixed alone at the top end of the main body 2 of the tree-shaped decoration.

Figure 5:
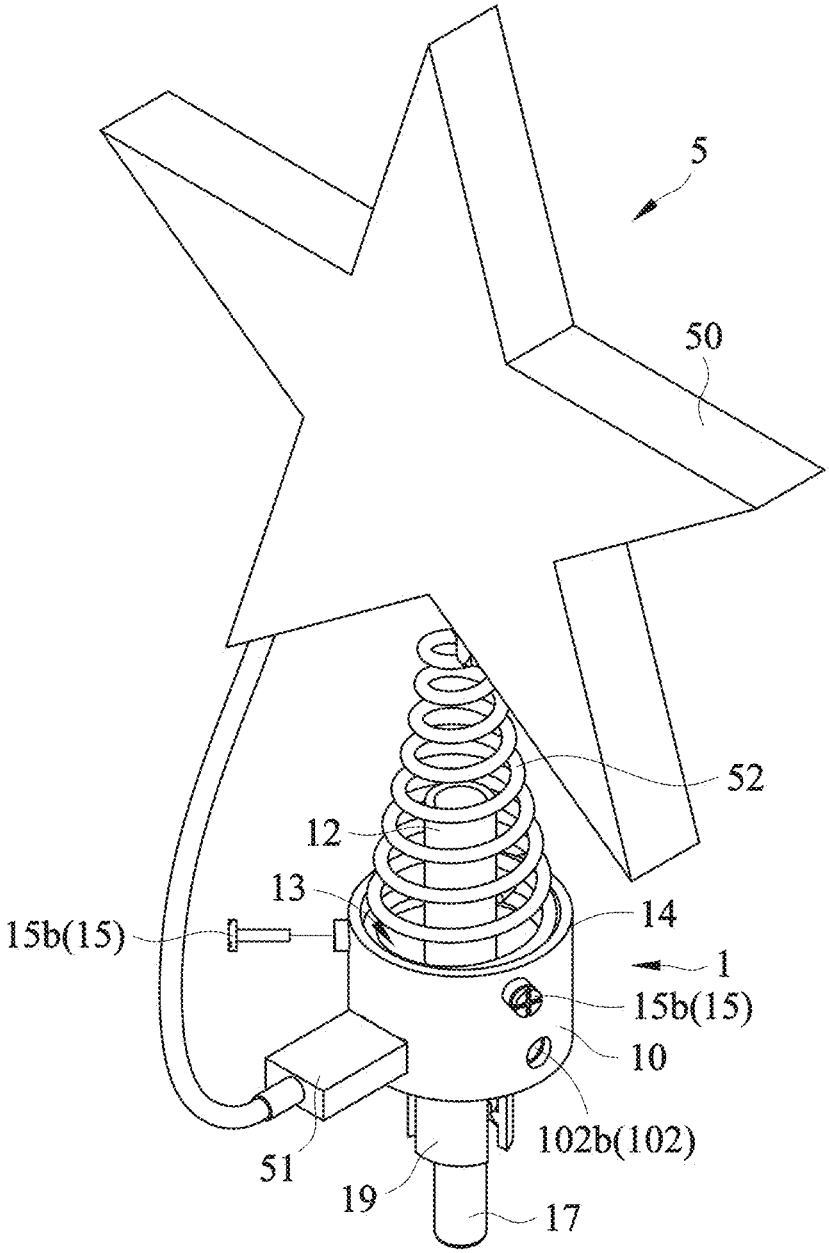
FIG. 5 shows how a spiral treetop decorative light is mounted on and coupled with the treetop mount according to another preferred embodiment of the invention.
Figure 6:
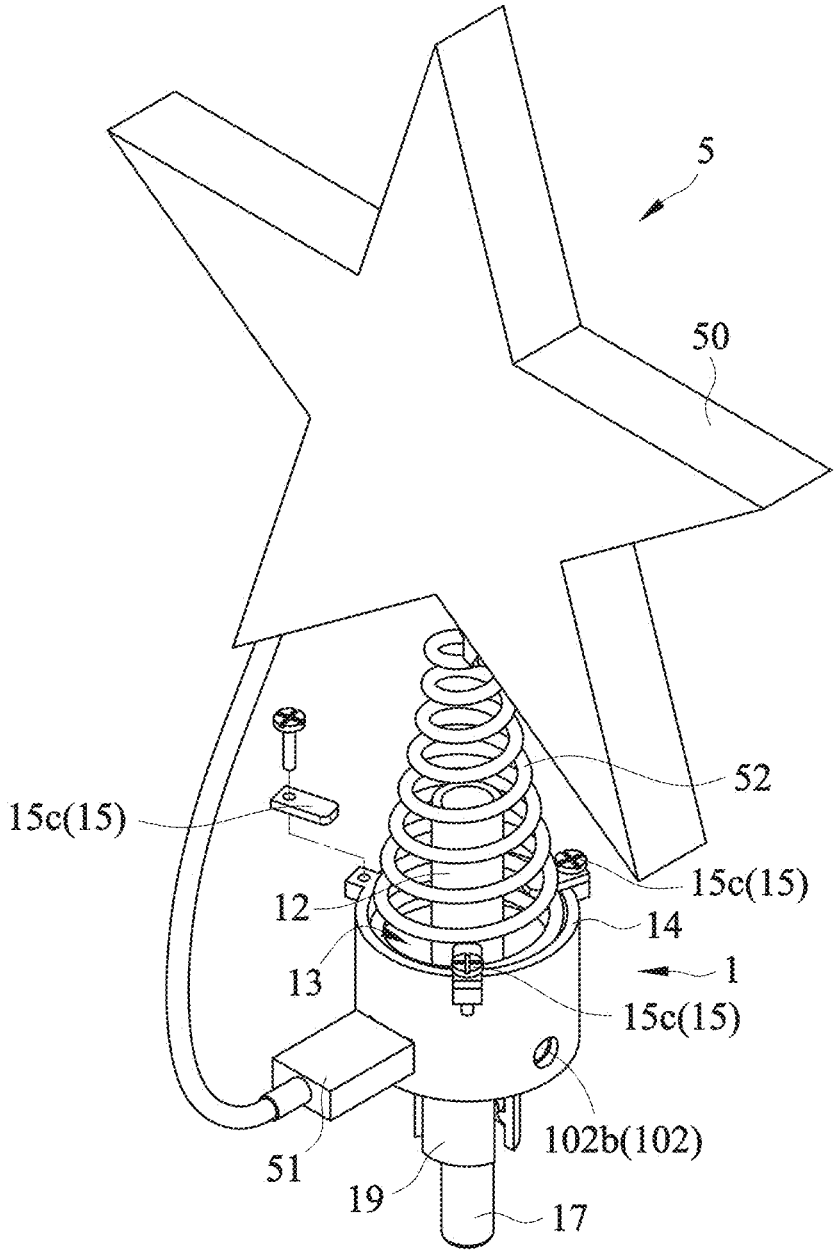
FIG. 6 shows how a spiral treetop decorative light is mounted on and coupled with the treetop mount according to still another preferred embodiment of the invention.

In one feasible embodiment, the blocking units 15 may take any of a variety of forms. In FIG. 4 for example, the blocking units 15 are elastic barbs 15*a* provided on the protruding edge 14 and extending inward of the position-limiting groove 13. The elastic barbs 15*a* allow the tube/wire in the bottom portion of the conical spiral support 52 to be placed into the position-limiting groove 13 and can block the tube/wire from moving out of the position-limiting groove 13 and thereby secure the treetop decorative light 5 in position. In FIG. 5, the blocking units 15 are screws 15*b* extending through the protruding edge 14, and the distance for which each screw 15*b* extends into the position-limiting groove 13 can be adjusted so that by adjusting the screws 15*b* (i.e., by moving the screws 15*b* outward or inward), the tube/wire in the bottom portion of the conical spiral support 52 can be either allowed to be put into the position-limiting groove 13 or blocked from moving out of the position-limiting groove 13 so as to secure the treetop decorative light 5 in place. In FIG. 6, the blocking units 15 are elastic plate-shaped elements 15*c* provided on the protruding edge 14 and can be rotated so that by rotating (i.e., adjusting the positions of) the plate-shaped elements 15*c*, the tube/wire in the bottom portion of the conical spiral support 52 can be either allowed to be put into the position-limiting groove 13 or blocked from moving out of the position-limiting groove 13 so as to secure the treetop decorative light 5 in place.

In this embodiment, referring to FIG. 7 and FIG. 8, the bottom end of the main trunk 21 of the main body 2 of the tree-shaped decoration is connected with a base 20, and the main trunk 21 at least includes a lower trunk portion 22 and an upper trunk portion 23 (there may be one or more middle trunk portions provided between the lower trunk portion 22 and the upper trunk portion 23 and having the same types of connectors). The lower trunk portion 22 is provided with a power connector 29 for connecting to an external power source, and the power connector 29 is electrically connected to the internal circuit 22*a* in the lower trunk portion 22. The top end of the upper trunk portion 23 is provided with the connected portion 27, to which the treetop mount 1 can be connected. The top end of the lower trunk portion 22 is provided with an upper connecting portion 25, and the upper connecting portion 25 is provided therein with an upper electrical connection terminal 251. The internal circuit 22*a* in the lower trunk portion 22 is electrically connected to the power connector 29 and the upper electrical connection terminal 251. The bottom end of the upper trunk portion 23 is provided with a lower connecting portion 26 configured to couple with the upper connecting portion 25, and the lower connecting portion 26 is provided therein with a lower electrical connection terminal 261. The internal circuit 23*a* in the upper trunk portion 23 is electrically connected to the lower electrical connection terminal 261 and the in-trunk electrical connection terminal 28. When a user connects the upper trunk portion 23 to the lower trunk portion 22, the lower connecting portion 26 is coupled to the upper connecting portion 25 to bring the lower electrical connection terminal 261 in the lower connecting portion 26 into contact, and hence electrical connection, with the upper electrical connection terminal 251 in the upper connecting portion 25 so that the electrical energy obtained by the power connector 29 can be transmitted through the internal circuit 22*a* in the lower trunk portion 22 to the internal circuit 23*a* in the upper trunk portion 23 and then through the upper trunk portion 23 to the treetop mount 1, thereby allowing the treetop mount 1 to supply electricity to the treetop decorative light 3, 4, or 5 through the power socket 102 formed on the lateral side of the mount body 10. This configuration not only optimizes and facilitates the power connection process during assembly, but also helps secure the treetop decorative light 3, 4, or 5 in position.

The embodiments described above are only some preferred ones of the present invention. Any extension, modification, simple change, or equivalent substitution based on the technical means of the invention shall fall within the scope of the invention. The scope of the invention is defined by the appended claims.

What is claimed is:

1. A universal treetop mount for fixedly coupling a treetop decorative light to a top end of a main body of a tree-shaped decoration, comprising:

a mount body having a bottom side provided with a connecting portion for coupling with the main body of the tree-shaped decoration, the mount body further having a top side forming an upper mount surface to be mounted and coupled with the treetop decorative light, wherein the upper mount surface is formed with a hollow positioning tube extending upward from a central position on the upper mount surface, the hollow positioning tube has a periphery circumferentially provided with a sunken position-limiting groove, and the position-limiting groove has a periphery provided with a plurality of blocking units arranged at intervals and configured to prevent an object received in the position-limiting groove from moving out of the position-limiting groove;

wherein the connecting portion includes a connecting tube and at least one clamping unit, the connecting tube is provided at a center of the bottom side of the mount body, extends downward, and is so configured that when coupled with the main body of the tree-shaped decoration, the connecting tube is inserted in an interior of, and thus coupled with, a connected portion at a top end of a main trunk of the main body of the tree-shaped decoration, and the clamping unit is provided around the connecting tube and is so configured that when coupled with the main body of the tree-shaped decoration, the clamping unit is clamped to a side of the connected portion that faces away from the connecting tube.

2. The universal treetop mount of claim 1, wherein the clamping unit forms a clamping wall extending downward from the bottom side of the mount body, and the clamping wall has an inner side protrudingly provided with a protruding tooth for pressing against the connected portion.

3. The universal treetop mount of claim 2, wherein there are a plurality of said clamping units, and the clamping units are provided at intervals around, and along a circumference of, the connecting tube.

4. The universal treetop mount of claim 1, wherein the main trunk is provided therein with an internal circuit for conducting electrical energy, the interior of the connected portion is provided with an in-trunk electrical connection terminal electrically connected to the internal circuit, the connecting portion is provided with an in-mount electrical connection terminal inside the connecting tube, and when the connecting portion is coupled with the connected portion, the in-mount electrical connection terminal of the connecting portion and the in-trunk electrical connection terminal in the connected portion are in contact, and hence in electrical connection, with each other.

5. The universal treetop mount of claim 4, wherein the mount body is further provided therein with a circuit board for voltage conversion and has a lateral side formed with at least one power socket electrically connected to the circuit board, and the circuit board is electrically connected to the in-mount electrical connection terminal and is configured to convert an input voltage into an output voltage suitable for the treetop decorative light and to output the output voltage to the power socket.

6. The universal treetop mount of claim 5, wherein the power socket is a universal serial bus (USB) socket or a direct-current (DC) socket.

7. The universal treetop mount of claim 3, wherein the main trunk is provided therein with an internal circuit for conducting electrical energy, the interior of the connected portion is provided with an in-trunk electrical connection terminal electrically connected to the internal circuit, the connecting portion is provided with an in-mount electrical connection terminal inside the connecting tube, and when the connecting portion is coupled with the connected portion, the in-mount electrical connection terminal of the connecting portion and the in-trunk electrical connection terminal in the connected portion are in contact, and hence in electrical connection, with each other.

8. The universal treetop mount of claim 7, wherein the mount body is further provided therein with a circuit board for voltage conversion and has a lateral side formed with at least one power socket electrically connected to the circuit board, and the circuit board is electrically connected to the in-mount electrical connection terminal and is configured to convert an input voltage into an output voltage suitable for the treetop decorative light and to output the output voltage to the power socket.

9. The universal treetop mount of claim 8, wherein the main body of the tree-shaped decoration further includes a power connector for connecting with a power source, and the power connector is electrically connected to the internal circuit.

10. The universal treetop mount of claim 9, wherein the main trunk of the main body of the tree-shaped decoration at least includes a lower trunk portion and an upper trunk portion, the power connector is provided at the lower trunk portion, the connected portion is provided at a top end of the upper trunk portion, a top end of the lower trunk portion and a bottom end of the upper trunk portion are provided with an upper connecting portion and a lower connecting portion respectively, and the upper connecting portion and the lower connecting portion are configured to couple with each other; the lower trunk portion is provided with an upper electrical connection terminal inside the upper connecting portion, a portion of the internal circuit that is in the lower trunk portion is electrically connected to the power connector and the upper electrical connection terminal, the upper trunk portion is provided with a lower electrical connection terminal inside the lower connecting portion, and a portion of the internal circuit that is in the upper trunk portion is electrically connected to the lower electrical connection terminal and the in-trunk electrical connection terminal; and when the lower connecting portion is coupled with the upper connecting portion, the lower electrical connection terminal in the lower connecting portion and the upper electrical connection terminal in the upper connection portion are in contact, and hence in electrical connection, with each other.

11. The universal treetop mount of claim 8, wherein the treetop decorative light includes a decorative light element and a supporting rod connected to and located under the decorative light element, and when the treetop decorative light is mounted on and coupled with the upper mount surface, the supporting rod is inserted in, and thus coupled with, the hollow positioning tube such that the treetop decorative light is securely fixed at the top end of the main body of the tree-shaped decoration.

12. The universal treetop mount of claim 8, wherein the treetop decorative light includes a decorative light element, a clamping element under the decorative light element, and a connecting rod connected between the decorative light element and the clamping element, and when the treetop decorative light is mounted on and coupled with the upper mount surface, the clamping element is fixed on an outer side of the hollow positioning tube in a clamping manner such that the treetop decorative light is securely fixed at the top end of the main body of the tree-shaped decoration.

13. The universal treetop mount of claim 8, wherein the treetop decorative light includes a decorative light element and a conical spiral support connected to and located under the decorative light element, and when the treetop decorative light is mounted on and coupled with the upper mount surface, a bottom portion of the conical spiral support is received in the position-limiting groove and is limited in position by the blocking units such that the treetop decorative light is securely fixed at the top end of the main body of the tree-shaped decoration.

14. The universal treetop mount of claim 13, wherein the blocking units are barbs provided on a protruding edge formed around, and protruding with respect to, the position-limiting groove, and the barbs extend inward of the position-limiting groove and are elastic.

15. The universal treetop mount of claim 13, wherein the blocking units are plate-shaped elements provided on a protruding edge formed around, and protruding with respect to, the position-limiting groove, and the plate-shaped elements are rotatable and elastic.

16. The universal treetop mount of claim 13, wherein the blocking units are screws extending through a protruding edge formed around, and protruding with respect to, the position-limiting groove, and each said screw extends into the position-limiting groove for an adjustable distance.

17. The universal treetop mount of claim 10, wherein the treetop decorative light includes a decorative light element and a supporting rod connected to and located under the decorative light element, and when the treetop decorative light is mounted on and coupled with the upper mount surface, the supporting rod is inserted in, and thus coupled with, the hollow positioning tube such that the treetop decorative light is securely fixed at the top end of the main body of the tree-shaped decoration.

18. The universal treetop mount of claim 10, wherein the treetop decorative light includes a decorative light element, a clamping element under the decorative light element, and a connecting rod connected between the decorative light element and the clamping element, and when the treetop decorative light is mounted on and coupled with the upper mount surface, the clamping element is fixed on an outer side of the hollow positioning tube in a clamping manner such that the treetop decorative light is securely fixed at the top end of the main body of the tree-shaped decoration.

19. The universal treetop mount of claim 10, wherein the treetop decorative light includes a decorative light element and a conical spiral support connected to and located under the decorative light element, and when the treetop decorative light is mounted on and coupled with the upper mount surface, a bottom portion of the conical spiral support is received in the position-limiting groove and is limited in position by the blocking units such that the treetop decorative light is securely fixed at the top end of the main body of the tree-shaped decoration.

* * * * *